US012674278B2

(12) United States Patent
Morris

(10) Patent No.: US 12,674,278 B2
(45) Date of Patent: Jul. 7, 2026

(54) PROCESS FOR PRODUCING AND USING FIBRILLATED BIODEGRADABLE MICROFIBERS

(71) Applicant: Nicholas Morris, Redondo beach, CA (US)

(72) Inventor: Nicholas Morris, Redondo beach, CA (US)

( * ) Notice: Subject to any disclaimer, the term of this patent is extended or adjusted under 35 U.S.C. 154(b) by 297 days.

(21) Appl. No.: 18/371,980

(22) Filed: Sep. 22, 2023

(65) Prior Publication Data

US 2024/0102238 A1 Mar. 28, 2024

Related U.S. Application Data

(60) Provisional application No. 63/474,867, filed on Sep. 23, 2022.

(51) Int. Cl.

| | |
|---|---|
| ***D21B 1/06*** | (2006.01) |
| ***D01B 1/00*** | (2006.01) |
| ***D01B 9/00*** | (2006.01) |
| ***D01C 1/00*** | (2006.01) |
| ***D21B 1/02*** | (2006.01) |
| ***D21C 3/02*** | (2006.01) |
| ***D21H 11/12*** | (2006.01) |
| ***D21H 17/00*** | (2006.01) |

(Continued)

(52) U.S. Cl.

CPC ..... *D21B 1/063* (2013.01); *D01B 1/00* (2013.01); *D01B 9/00* (2013.01); *D01C 1/00* (2013.01); *D21B 1/021* (2013.01); *D21C 3/024* (2013.01); *D21H 11/12* (2013.01); *D21H 17/005* (2013.01); *D21H 17/02* (2013.01); *D21H 17/14* (2013.01); *D21H 17/28* (2013.01); *D21H 17/66* (2013.01); *D10B 2201/01* (2013.01); *D10B 2401/12* (2013.01)

(58) Field of Classification Search

CPC ..... D21B 1/063
USPC ..... 162/13
See application file for complete search history.

(56) References Cited

U.S. PATENT DOCUMENTS 2,530,322 A 11/1950 Ash
5,702,499 A 12/1997 Timmenga
(Continued)

*Primary Examiner* — Jacob T Minskey

(57) ABSTRACT

The present invention relates to the field of textiles. More specifically, it pertains to a process for producing and using fibrillated biodegradable microfibers.

The process involves sourcing and preliminary processing plant materials encompassing cellulose-rich fibers followed by mechanical compression method or a solar powered electric presser to expel surplus moisture. Then, an aqueous immersion technique is employed for thermal processing to obtain thermal processed plant materials. The thermal processed plant materials then undergo a rinsing step and a mechanical disintegration step to reduce the thermal processed plant materials into micro-sized entities while maintaining the integrity of the fibers. Furthermore, matrix forming substances, stabilizer, sealant and preservative to said micro-sized entities subsequently undergoing a blending process to obtain a first mixture. Lastly, the first mixture is exposed to a controlled desiccation regimen followed by implementing a mechanical reduction process resulting in the attainment of said fibrillated biodegradable microfibers with a diameter measurement below the threshold of 10 μm.

9 Claims, 4 Drawing Sheets

(51) Int. Cl.

| | |
|---|---|
| ***D21H 17/02*** | (2006.01) |
| ***D21H 17/14*** | (2006.01) |
| ***D21H 17/28*** | (2006.01) |
| ***D21H 17/66*** | (2006.01) |

(56) References Cited

U.S. PATENT DOCUMENTS

| | | | | |
|---|---|---|---|---|
| 5,769,335 | A | 6/1998 | Shutov | |
| 6,110,588 | A | 8/2000 | Perez et al. | |
| 6,737,004 | B2 | 5/2004 | Wang et al. | |
| 7,094,317 | B2 | 8/2006 | Lundberg et al. | |
| 8,647,689 | B2 | 2/2014 | Vanhemelrijck et al. | |
| 9,090,372 | B2 | 7/2015 | Warner | |
| 9,370,292 | B2 | 6/2016 | Sumnicht et al. | |
| 9,382,665 | B2 * | 7/2016 | Miller | B31F 1/126 |
| 9,771,435 | B2 | 9/2017 | Santanocito et al. | |
| 10,052,636 | B2 | 8/2018 | Bates | |
| 10,334,870 | B2 * | 7/2019 | Han | A23L 2/02 |
| 10,982,381 | B2 | 4/2021 | Haverhals et al. | |
| 11,524,479 | B2 | 12/2022 | Hijosa et al. | |
| 2006/0159833 | A1 | 7/2006 | Radatti | |
| 2010/0264079 | A1 | 10/2010 | Begin et al. | |
| 2020/0063295 | A1 * | 2/2020 | Mitchell | D21H 13/24 |
| 2022/0033995 | A1 | 2/2022 | Schiros et al. | |

* cited by examiner

| Item / Unit | Cut length | | Linear density of fiber | | Average breaking tenacity | Moisture regain |
|---|---|---|---|---|---|---|
| | mm | cv(%) | Tex | cv(%) | cN/tex | (%) |
| ECOFA | 22-35<br>38-87 | 24.5 | 2.2 | 14.6 | 32.7 | 10.9 |

FIG. 1

| | ASTM D 5867 - 12 (20)<br>The test results were measured by USTER®HVI Spectrum I | | | | | | | | | | | | |
|---|---|---|---|---|---|---|---|---|---|---|---|---|---|
| | SCI | Rd | +b | C-G | Cnt | Area | Tr-G | CGrd | Mic | Strength (gpt) | SFI | Uniformity (Unf) | Length UHML (Inch) |
| ECOFA | 5.99 | 67.8 | 15.3 | 24-3 | 4 | 0.05 | 1 | 12-1 | 5.8 | 60.20 | 8.6 | 78.40 | 1.410 |

FIG. 2

99% degraded within 43 days
100% inside 50

| Anti-bacterial and anti-fungal hence Odor-resistant | | | | |
|---|---|---|---|---|
| Factor | Temperature (w) | Solid - Liquid ratio (L) | Time (T) | IZD (mm) |
| 1 | 1 | 1 | 1 | 9.44 |
| 2 | 1 | 2 | 2 | 10.65 |
| 3 | 1 | 3 | 3 | 10.9 |
| 4 | 2 | 1 | 2 | 12.29 |
| 5 | 2 | 2 | 3 | 10.5 |
| 6 | 2 | 3 | 1 | 11.5 |
| 7 | 3 | 1 | 3 | 10.3 |
| 8 | 3 | 2 | 1 | 9.0 |
| 9 | 3 | 3 | 2 | |
| K1 | 10.297 | 10.230 | 10.320 | |
| K2 | 11.050 | 10.310 | 10.200 | |
| K3 | 9.700 | 10.506 | 10.527 | |
| Maximum | 1.350 | 0.277 | 0.327 | |

FIG. 6

PROCESS FOR PRODUCING AND USING FIBRILLATED BIODEGRADABLE MICROFIBERS

FIELD OF THE INVENTION

The present invention relates to the field of textiles. More specifically, it pertains to a process for producing and using fibrillated biodegradable microfibers.

BACKGROUND

Microfibers, tiny synthetic fibers with diameters thinner than a human hair, have revolutionized industries like fashion, sports, and cleaning due to their softness, durability, and versatility. However, their non-biodegradable nature and the environmental concerns associated with microplastic pollution have prompted the development of biodegradable microfibers as a sustainable alternative. The global imperative for sustainable materials has catalyzed research and innovation in the domain of biodegradable microfibers. Synthetic microplastics, predominantly comprising non-degradable polymers, have unleashed a monumental environmental crisis. Biodegradable microfibers have emerged as a crucial response to the pervasive environmental problem of microplastic pollution, primarily originating from synthetic microfibers commonly used in textiles and other applications. Microfibers, defined as fibers with diameters less than 10 micrometers, have gained notoriety due to their role in environmental pollution. They often shed from synthetic textiles during washing and enter aquatic ecosystems, contributing to the contamination of oceans and waterways. These tiny plastic particles are ingested by marine life, posing ecological threats and potentially entering the food chain. Unlike conventional synthetic microfibers, biodegradable microfibers can naturally degrade into harmless compounds in the environment, thus mitigating their adverse environmental impact.

In response to this environmental crisis, researchers, scientists, and the textile industry have initiated efforts to develop biodegradable microfibers. Unlike conventional synthetic microfibers, biodegradable microfibers can naturally degrade into harmless compounds in the environment, thus mitigating their adverse environmental impact. The omnipresence of synthetic microfibers, notorious for their non-biodegradability, poses an intractable environmental conundrum. These minuscule fibers persistently infiltrate terrestrial and aquatic ecosystems, compromising soil quality, contaminating water bodies, endangering fauna, and even infiltrating the human food chain. Consequently, there is an unequivocal imperative to manifest sustainable, biodegradable microfiber alternatives that serve as ecological guardians. The existing landscape of biodegradable microfiber production predominantly centers on cellulose-based materials or biodegradable synthetic polymers.

While these forays represent commendable strides towards ecological sustainability, they often entail resource-intensive processes and may not seamlessly replicate the mechanical properties innate to plant-derived microfibers. The innovation articulated within this patent application delineates a nuanced, environmentally sentient methodology for the generation of biodegradable microfibers, intricately hinging upon select plant-based precursors. This intricate process harnesses the distinctive mechanical attributes of specific plant fibers orchestrating their transformation into microfibers that marinate in the best of all worlds—unyielding mechanical prowess, enduring durability, and impeccable biodegradability.

The future of biodegradable microfibers is promising. Continued research and innovation aim to improve their mechanical properties, cost-efficiency, and scalability. As sustainable materials, biodegradable microfibers have the potential to revolutionize industries reliant on microfibers while significantly reducing environmental harm and promoting a more sustainable future. In conclusion, biodegradable microfibers represent a multifaceted solution to mitigate the detrimental impact of synthetic microfiber pollution. Their development and adoption contribute to the broader goals of sustainability, ecological conservation, and environmental stewardship. The present patent application endeavours to safeguard the intricate processes and pioneering compositions involved in the synthesis of biodegradable microfibers derived from plant sources, promising a paradigm shift across sectors, encompassing textiles, agriculture, and multifarious industrial applications.

OBJECTS OF THE INVENTION

Some of the objects of the present disclosure, which at least one embodiment herein satisfies, are as follows:

- It is an object of the present disclosure to ameliorate one or more problems of the prior art or to at least provide a useful alternative;
- An object of the present disclosure is to provide a process for producing and using fibrillated biodegradable microfibers;
- Other objects and advantages of the present disclosure will be more apparent from the following description, which is not intended to limit the scope of the present disclosure.

SUMMARY

In one aspect, the present invention envisages a process for producing fibrillated biodegradable microfibers from organic plant materials. The process comprises initially sourcing plant materials encompassing cellulose-rich fibers, the plant materials originating from diverse botanical sources. Further, the same undergo performing preliminary processing steps that encompass conditioning, sorting, and, optionally, pretreatment with enzymatic or chemical agents to eliminate impurities, non-cellulosic compounds, and waxy substances from the selected plant materials, thereby enhancing the cellulose purity. The next step involves utilizing a mechanical compression method or a solar powered electric presser to expel surplus moisture from the selected plant materials to obtain compressed plant materials. This is followed by an aqueous immersion technique to subject the compressed plant materials to thermal processing for a pre-determined time and temperature to obtain thermal processed plant materials. The obtained thermal processed plant materials are subjected to a meticulous aqueous rinsing step, designed to effectively extricate and thoroughly disengage any lingering vestiges of the solvent.

Typically, the next step involves employing mechanical disintegration means, comprising high intensity ultrasonication, mechanical shear, or microfluidization, in conjunction with pressure modulation, to reduce the thermal processed plant materials into micro-sized entities while maintaining the integrity of the fibers. This is followed by adding at least one of matrix forming substance, stabilizer, sealant and preservative to the micro-sized entities subsequently undergoing a blending process to obtain a first mixture.

Lastly, the obtained first mixture is exposed to a controlled desiccation regimen employing a precision hot air convection apparatus, diligently regulating temperature and airflow parameters, until the attainment of a targeted moisture of 15% thereby obtaining dried first mixture and then implementing a mechanical reduction process, involving the dried first mixture, resulting in the attainment of the fibrillated biodegradable microfibers with a diameter measurement below the threshold of 10 μm.

BRIEF DESCRIPTION OF THE DRAWINGS

For a more complete understanding of the present disclosure, reference is now made to the following description taken in conjunction with the accompanying drawings.

FIG. 1 illustrates the test results for cottonised pineapple fiber.

FIG. 2 illustrates the test results for cottonised pineapple fiber measured by USTER HVI Spectrum I.

FIG. 6 illustrates the test anti-bacterial and anti-fungal (odor resistant) results for cottonised pineapple.

DETAILED DESCRIPTION

Figure 3:
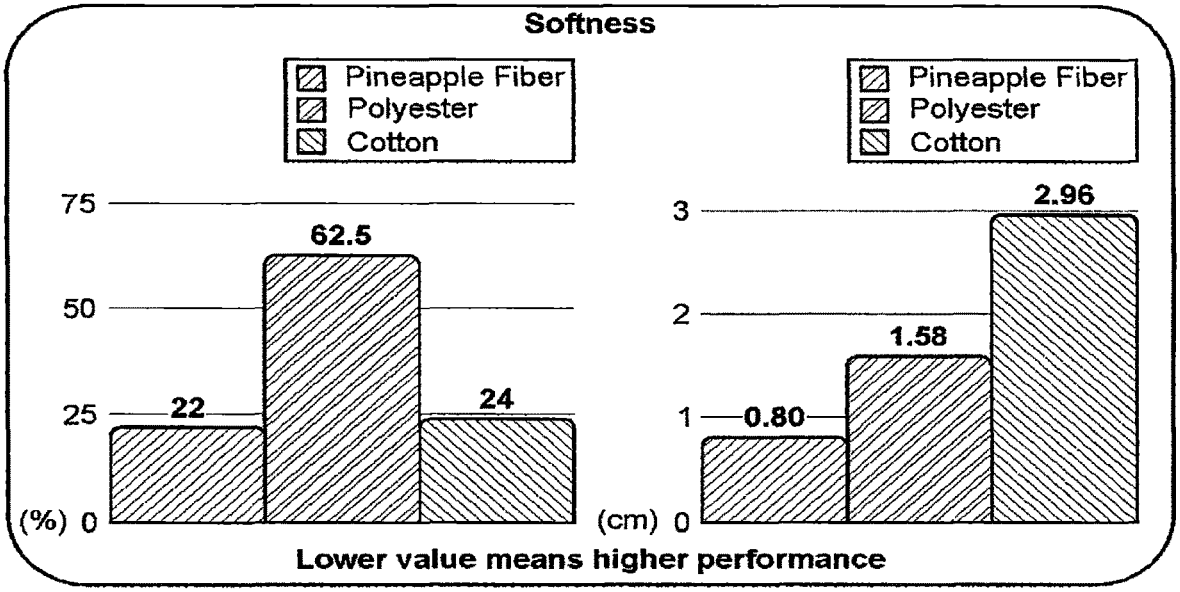
FIG. 3 illustrates the test results for softness of the cottonised pineapple fiber.

The detailed description set forth below, in connection with the appended drawing, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. As described herein, the use of the term "and/or" is intended to represent an "inclusive OR", and the use of the term "or" is intended to represent an "exclusive OR".

The disclosure will now be described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

In one aspect, the present invention envisages a process for producing fibrillated biodegradable microfibers from organic plant materials. The process comprises the following steps:

a) sourcing plant materials encompassing cellulose-rich fibers, the plant materials originating from diverse botanical sources;
b) performing preliminary processing steps that encompass conditioning, sorting, and, optionally, pretreatment with enzymatic or chemical agents to eliminate impurities, non-cellulosic compounds, and waxy substances from the selected plant materials, thereby enhancing the cellulose purity;
c) utilizing a mechanical compression method or a solar powered electric presser to expel surplus moisture from the selected plant materials to obtain compressed plant materials;
d) employing aqueous immersion techniques to subject the compressed plant materials to thermal processing for a pre-determined time and temperature to obtain thermal processed plant materials;
e) subjecting the thermal processed plant materials to a meticulous aqueous rinsing step, designed to effectively extricate and thoroughly disengage any lingering vestiges of the solvent;
f) employing mechanical disintegration means, comprising high-intensity ultrasonication, mechanical shear, or microfluidization, in conjunction with pressure modulation, to reduce the thermal processed plant materials into micro-sized entities while maintaining the integrity of the fibers;
g) adding at least one of matrix forming substance, stabilizer, sealant and preservative to the micro-sized entities subsequently undergoing a blending process to obtain a first mixture;
h) exposing the first mixture to a controlled desiccation regimen employing a precision hot air convection apparatus, diligently regulating temperature and airflow parameters, until the attainment of a targeted moisture of 15% thereby obtaining dried first mixture;
i) implementing a mechanical reduction process, involving the dried first mixture, resulting in the attainment of the fibrillated biodegradable microfibers with a diameter measurement below the threshold of 10 μm.

In an embodiment of the present invention, the plant materials are selected from the group of *Musa textilis, Ananas comosus, Imperata cylindrica, Musa paradisiaca* and *Cocos nucifera.*

In another embodiment of the present invention, the aqueous immersion techniques includes introduction of the compressed plant materials into a controlled solvent environment configured to enable controlled dissolution of non-cellulosic components.

In an exemplary embodiment of the present invention, the solvent environment comprises at least one solvent selected from the group comprising water and sodium hydroxide and hydrogen peroxide.

In yet another embodiment of the present invention, the matrix forming substance is at least one plant based binding agent, selected from the group of roots, tuber crops, carrava, corn, rice starches.

In still another embodiment of the present invention, the stabilizer is at least one natural pulp enzyme, selected from the group of extract from vegetable okra (*Abelmoschus esculentus*), pectin, lecithin and carrageenan.

In another exemplary embodiment of the present invention, the sealant is at least one plant-based sealant, is a biopolymer selected from the group of mushroom extract (*Agaricus bisporus*) and fungus.

In still another embodiment of the present invention, the preservative is at least one water-soluble preservative, selected from the group of salt, vinegar and combinations thereof.

In another embodiment of the present invention, the process as claimed in claim 1, further comprises the steps of:

- isolating and recovering the fibrillated biodegradable microfibers by means of continuous-flow centrifugation, tangential flow filtration, or ultrafiltration techniques, followed by re-dissolution and re-filtration for further refinement;
- employing post-processing strategies, involving controlled temperature, pressure, and surface modification, to optimize the dimensions, surface properties, and physical characteristics of the fibrillated biodegradable microfibers possessing a diameter, between approximately 0.1 to 10 μm, with a controlled distribution profile;
- fabricating microfiber-based materials and products, encompassing textiles, composites, or papers, from the obtained fibrillated biodegradable microfiber via methods such as spinning, weaving, knitting, or layering;
- optionally, incorporating additives, functionalizing agents, or surface coatings into the microfiber-based materials and products to enhance specific properties or applications thereof; and
- characterizing the resulting microfiber-based materials and products via spectroscopic, microscopic, thermal, mechanical, or surface analysis techniques, thereby verifying the quality, consistency, and functionality of the microfiber-based materials and products.

In still another exemplary of the present invention, germeable seeds are embedded before making articles from the microfibers.

TECHNICAL ADVANCES AND ECONOMICAL SIGNIFICANCE

- Prudent Resource Sourcing: The process employs plant-derived raw materials, resulting in a commendable reduction in the carbon footprint traditionally associated with microfiber production.
- Sublime Biodegradability: These microfibers, exquisitely engineered, partake in nature's own rhythm, undergoing graceful decomposition, mitigating the grotesque specter of environmental permanence.
- Mechanical Finesse: The resultant microfibers proudly parade their mechanical finesse, tailored for an array of applications including, but not limited to, textiles, agriculture, and sustainable packaging.
- Responsible Efficiency: The production protocol bows to energy efficiency and waste minimization, presenting a cost-effective, conscientious approach.
- Vestments of Sustainability: These biodegradable microfibers fashioned from plants hold infinite promise in the textile industry, adorning clothing, upholstery, and diverse fabric products with an eco-halo.
- Cultivating Sustainability: Agricultural landscapes stand to benefit as these microfibers, laid judiciously, enhance soil health and water retention, elevating crop productivity and bolstering sustainability.
- Packaging Revolution: Biodegradable microfibers gracefully infiltrate the realm of packaging materials, dethroning the plastic menace and heralding a green era.

EXAMPLES

Example 1: Waste Pineapple Leaves Transformed into Sustainable Specialty Paper The microfibers were obtained by the process as mentioned hereinabove.

| Formulations | 1 (based on weight of material) | 2 (based on weight of material) | 3 (based on weight of material) |
|---|---|---|---|
| Starch | 1 to 2% | 1.5 to 3% | 3.5 to 6.08% |
| Dowlatex | 8.5 to 11.8% | 0 to 0.6% | 7.8 to 12% |
| Binder | 0 to 0.5% | 7.8 to 12% | 8.8 to 12.5% |
| Almaciga Resin | 0 to 0.5% | 27.5 to 36.8% | 27.5 to 36.8% |

Based on the above mentioned 3 formulations, coffee sleeves were manufactured and then tested for their physical properties. It was observed that there was a significant difference on the basis weights of the Pineapple formulations, Formulation 3 weighed the most. It can be interpreted that in a scenario when all the formulations have the same area during paper production, Formulation 3 will be the thickest, followed by Formulation 1 and Formulation 2.

Similarly, experiments on tensile and tear indices of the Pineapple formulations yielded similar results wherein Formulation 3 possessed significant increase in the tensile strength and tear indices over Formulations 1 and 2 respectively. This invariably meant that the sleeve prepared from Formulation 3 would need the highest amount of force to break apart.

Figure 4:
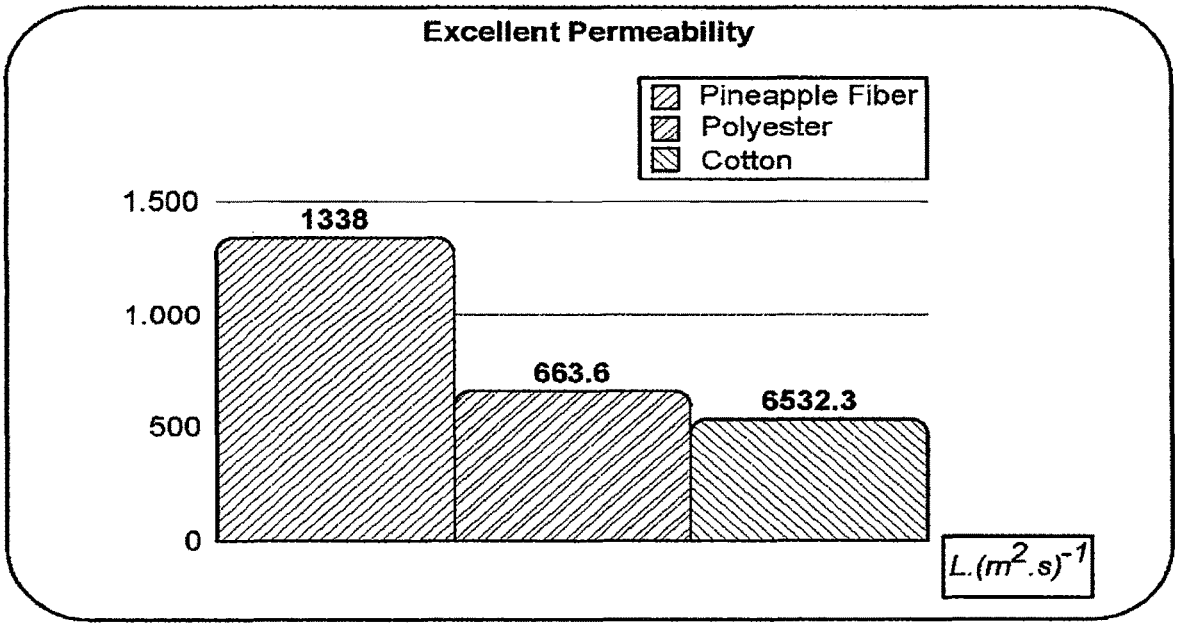
FIG. 4 illustrates the test results for permeability of the cottonised pineapple fiber.
Figure 5:
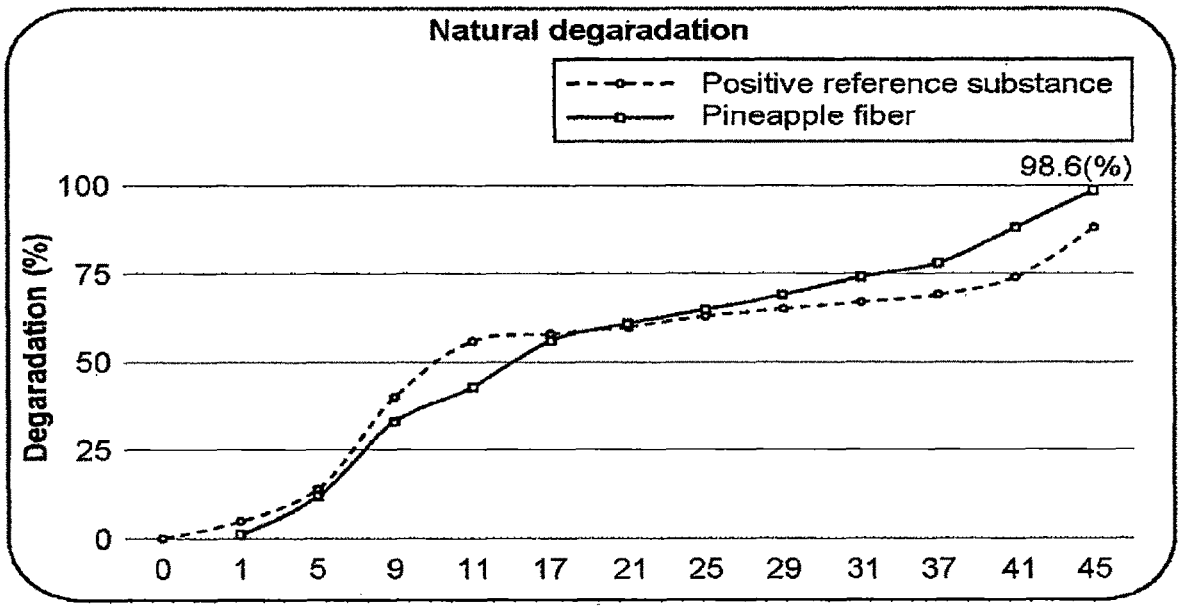
FIG. 5 illustrates the test results for natural degradation of the cottonised pineapple fiber.

Experiments to access the bending resistance concluded that Formulation 2 was the stiffest, followed by Formulation 1 then Formulation 3. This would mean that Formulation 2 was more bending resistant while Formulation 3 was the least. Whereas regarding moisture content and water absorption, there were significant differences as Formulation 2 had the highest moisture content followed by 3 then 1. FIG. 1 illustrates the test results for cottonised pineapple fiber. FIG. 2 illustrates the test results for cottonised pineapple fiber measured by USTER HVI Spectrum I. FIG. 3 illustrates the test results for softness of the cottonised pineapple fiber; wherein lower value means higher performance. FIG. 4 illustrates the test results for permeability of the cottonised pineapple fiber. FIG. 5 illustrates the test results for natural degradation of the cottonised pineapple fiber; wherein 99% pineapple fiber is degraded within 43 days and 100% inside 50 days. FIG. 6 illustrates the test anti-bacterial and anti-fungal (odor resistant) results for cottonised pineapple.

Example 2: Food Contact Testing | 21 CFR US-FDA Part 176 170 on Paper and Paperboard The paper and paperboard as prepared by the process mentioned hereinabove was tested for food contact as per the above-mentioned US-FDA protocol. The test was carried out at room temperature on different food products as prescribed in the protocol. Some examples being:

- Nonacidic, aqueous products (with and without salt and sugar—pH above 5);
- Acidic, aqueous products (with and without salt, sugar and oil in water emulsion (low and high fat content);
- Dairy products and modifications; water-in-oil emulsions, high-low-fat;
- Alcoholic beverages containing up to 3% alcohol and Non-alcoholic beverages;
- Moist bakery products with surface containing free fat or Oil; and
- Moist bakery products with surface containing no free fat or oil.

| TEST CONDUCTED | Pineapple | Beeswax-coated Pineapple | LIMIT |
|---|---|---|---|
| Total Soluble Extractive in Water Extractant, 120 F., 24 hours. | <0.10 mg/in2 | <0.10 mg/in2 | 0.5 mg/in2 |
| Total Soluble Extractive in n-Heptane Extractant, 70 F., 30 mins | <0.10 mg/in2 | <0.10 mg/in2 | 0.5 mg/in2 |
| Total Soluble Extractive in 8% Ethanol Extractant, 120 F., 24 hrs | <0.10 mg/in2 | <0.10 mg/in2 | 0.5 mg/in2 |
| RESULTS | PASS | PASS | |

Remarks
< = less than
F = degree Fahrenheit
mg/in2= milligram per square inch

Example 3: Pulp samples were prepared using recycled old corrugating cartons (OCC) in ratio with ground Pineapple pulp and ground pineapple fruit waste pulp. Initially, to see the visual outcome of mixing furnish ratio of ground fruit samples with recycled pulp, hand sheets were formed according to TAPPI Standard using a hand sheet former wherein latter, freeness of the pulp was determined.

| Sample | Ratio | Freeness, csf |
|---|---|---|
| Ground Pineapple Pulp: OCC | 1:9 | 277 |
| Ground Pineapple Pulp: OCC | 1:4 | 316 |
| Ground Pineapple Pulp: OCC | 1:2 | 406 |
| Ground Pinefruit Pulp: OCC | 1:9 | 296 |
| Ground Pinefruit Pulp: OCC | 1:4 | 354 |
| Ground Pinefruit Pulp: OCC | 1:2 | 325 |

During the procedure it was observed that pineapple fruit waste pulp produces brittle and rough sheets. Small hard particles can lodge into paper machine clothing and press rollers that may cause detrimental issues in longer runs. Ground Pineapple pulp though, showed promising results than fruit waste.

While the invention has been particularly shown and described with reference to specific embodiments, it should be understood by those skilled in the art that various changes in form and detail may be made therein without departing from the spirit and scope of the invention as defined by the appended claims. For example, membrane shapes other than housing that also exhibit high gas exchange may be used. Further, the oxygenator catheter may be integrated into a device that also encompasses other functions, such as blood filtration to augment renal and other organ functions. For example, relational terms, such as "above" and "below' are used with respect to a view of the device as shown in the present disclosure. Of course, if the device is inverted, above becomes below, and vice versa. Additionally, if oriented sideways, above and below may refer to sides of a device. Moreover, the scope of the present application is not intended to be limited to the particular configurations of the process, machine, manufacture, and composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. The scope of the invention is indicated by the appended embodiments, and all changes which come within the meaning and range of equivalency of the embodiments are intended to be embraced.

The description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but are to be accorded the widest scope consistent with the principles and novel features disclosed herein.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further purposes and advantages, will be better understood from the following description when considered in connection with the accompanying figures. It is to be expressly understood, however, that each of the figures is provided for the purposes of illustration and description only and is not intended as a definition of the limits of the present disclosure.

Although several embodiments have been described in detail for purposes of illustration, various modifications may be made without departing from the scope and spirit of the present disclosure. Accordingly, the disclosure is not to be limited by the examples presented herein but is envisioned as encompassing the scope described in the appended claims and the full range of equivalents of the appended claims.

The invention claimed is:

1. A process for producing fibrillated biodegradable microfibers from organic plant materials, consisting essentially of in order of the following steps:

sourcing only plant materials;

b) performing conditioning, sorting, with enzymatic or chemical agents to eliminate impurities, non-cellulosic compounds, and waxy substances from the selected plant materials, c) utilizing compression method to expel surplus moisture from said selected plant materials to obtain compressed plant materials;

d) employing aqueous immersion techniques to subject said compressed plant materials to thermal processing for a pre-determined time and increased temperature to obtain thermal processed plant materials into a solvent;

e) subjecting said thermal processed plant materials to a aqueous rinsing step, designed to effectively extricate and disengage any vestiges of said solvent;

f) employing mechanical disintegration means, comprising high-intensity ultrasonication, mechanical shear, or microfluidization, in conjunction with pressure modulation, to reduce the thermal processed plant materials into micro-sized entities while maintaining the integrity of the fibers;

g) adding at least one of matrix forming substance, stabilizer, sealant and preservative to said micro-sized entities subsequently undergoing a blending process to obtain a first mixture;

h) exposing said first mixture to a controlled desiccation regimen employing a precision hot air convection apparatus, regulating temperature and airflow parameters, until the attainment of a targeted moisture of 15% thereby obtaining dried first mixture;

i) implementing a mechanical reduction process, involving said dried first mixture, resulting in the attainment of a fibrillated biodegradable microfibers with a diameter measurement below a threshold of 10 μm j) isolating and recovering said fibrillated biodegradable microfibers; and k) optionally, employing post-processing strategies.

2. The process as claimed in claim 1, wherein said plant materials are selected from the group of *Musa textilis, Ananas comosus, Imperata cylindrica, Musa paradisiaca* and *Cocos nucifera.*

3. The process as claimed in claim 1, wherein said aqueous immersion techniques includes introduction of said compressed plant materials into a controlled solvent environment configured to enable controlled dissolution of non-cellulosic components.

4. The process as claimed in claim 3, wherein said solvent environment comprises at least one solvent selected from the group comprising water and sodium hydroxide and hydrogen peroxide.

5. The process as claimed in claim 1, wherein said matrix forming substance is at least one plant based binding agent, selected from the group of roots, tuber crops, carrava, corn, rice starches.

6. The process as claimed in claim 1, wherein said stabilizer is at least one natural pulp enzyme, selected from the group of extract from vegetable okra (*Abelmoschus esculentus*), pectin, lecithin and carrageenan.

7. The process as claimed in claim 1, wherein said sealant is at least one plant-based sealant, is a biopolymer selected from the group of mushroom extract (*Agaricus bisporus*) and fungus.

8. The process as claimed in claim 1, wherein said preservative is at least one water-soluble preservative, selected from the group of salt, vinegar and combinations thereof.

9. The process as claimed in claim 1, wherein said isolating and recovering said fibrillated biodegradable microfibers by means of continuous-flow centrifugation, tangential flow filtration, or ultra-filtration techniques, followed by re-dissolution and re-filtration for further refinement; and including post-processing strategies, involving controlled temperature, pressure, and surface modification, to optimize the dimensions, surface properties, and physical characteristics of said fibrillated biodegradable microfibers possessing a diameter, between approximately 0.1 to 10 μm, with a controlled distribution profile.

* * * * *